US008756773B2

(12) United States Patent
Kienzle et al.

(10) Patent No.: US 8,756,773 B2
(45) Date of Patent: Jun. 24, 2014

(54) DECORATIVE SYSTEM WITH FASTENERS AND INTERCHANGEABLE CONNECTORS

(75) Inventors: Sarah Yarger Kienzle, Lake Forest, IL (US); Siarhei Murauyou, Chicago, IL (US); Marianne Grisdale, Chicago, IL (US); Cliff Krapfl, Chicago, IL (US)

(73) Assignee: Cygnet Hill Ltd., Lake Forest, IL (US)

( * ) Notice: Subject to any disclaimer, the term of this patent is extended or adjusted under 35 U.S.C. 154(b) by 591 days.

(21) Appl. No.: 12/902,211

(22) Filed: Oct. 12, 2010

(65) Prior Publication Data

US 2012/0085129 A1 Apr. 12, 2012

(51) Int. Cl.
*A44B 99/00* (2010.01)

(52) U.S. Cl.
USPC ..... 24/574.1; 24/327; 24/376; 24/587.11; 59/85; 59/89; 63/3.1

(58) Field of Classification Search
None
See application file for complete search history.

(56) References Cited

U.S. PATENT DOCUMENTS

| | | | | |
|---|---|---|---|---|
| 1,578,940 | A * | 3/1926 | Wacha | 24/116 A |
| 1,895,952 | A * | 1/1933 | Wachenheimer | 24/574.1 |
| 2,596,716 | A * | 5/1952 | Otten | 70/456 R |
| 4,581,904 | A * | 4/1986 | Lehmann et al. | 63/23 |
| 5,722,260 | A | 3/1998 | Mangano | |
| 6,422,036 | B1 | 7/2002 | Giannis et al. | |
| 6,508,080 | B1 * | 1/2003 | Ninomiya | 63/3.1 |
| 6,701,583 | B1 | 3/2004 | McCullough | |
| 6,718,797 | B2 | 4/2004 | Plumly | |
| 6,729,159 | B2 | 5/2004 | Rose | |
| 2008/0256978 | A1 | 10/2008 | Chan | |

* cited by examiner

*Primary Examiner* — Jack W. Lavinder
(74) *Attorney, Agent, or Firm* — Miller, Matthias & Hull LLP

(57) ABSTRACT

A system of fasteners and connectors that can be used as part of fashion items such as jewelry, leather goods and garments is provided. One or more fasteners can be used interchangeably with a range of connectors to accommodate various kinds of decorative and functional applications.

2 Claims, 14 Drawing Sheets

10
14
16
20
38
40
42
50
52
54
56
58

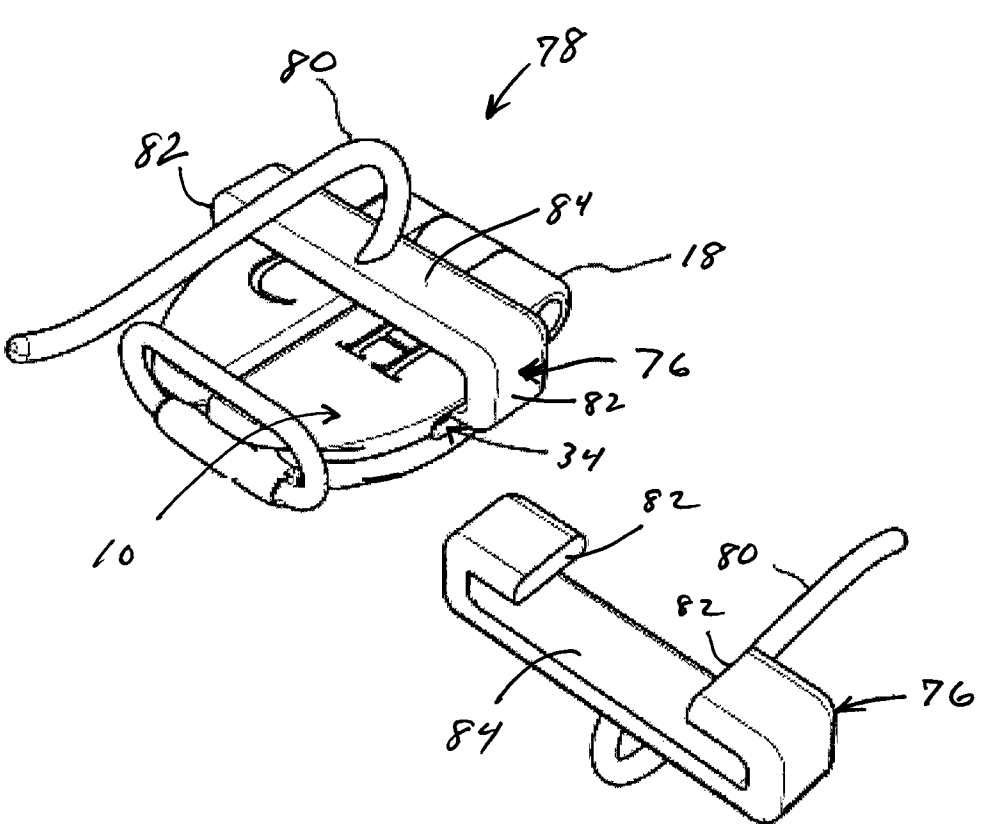
FIG. 13
FIG. 14
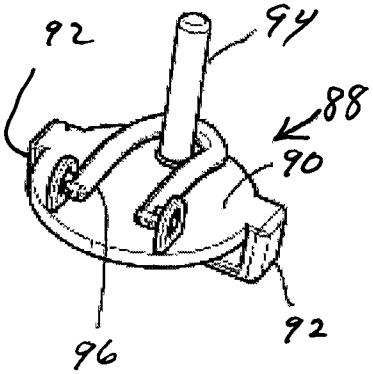
FIG. 15

DECORATIVE SYSTEM WITH FASTENERS AND INTERCHANGEABLE CONNECTORS

BACKGROUND

1. Field of the Invention

This patent relates to a decorative system comprising one or more fasteners and interchangeable mating connectors that may be used to link to the fasteners, to other elements or to each other. More particularly, this invention relates to a versatile, clamshell-type fastener of which one or more can be combined with various connectors to create jewelry items (including but not limited to necklaces, bracelets, earrings, rings, watches and cufflinks); decorate non-jewelry fashion items (including but not limited to shoes, handbags, wallets and garments); or decorate any other item where interchangeable aesthetics and/or function are desired.

2. Description of the Related Art

Numerous types of fasteners have been devised for use exclusively with jewelry pieces and, more specifically with necklaces and bracelets only. For example, Mangano U.S. Pat. No. 5,722,260 discloses a clamshell type fastener for connecting the two ends of a strand of pearls or the two ends of a chain necklace. The fastener comprises hooks 72, 74 mounted inside the fastener for receiving the loop ends 22 of the pearl strand. The two covers may be held together in the closed position by magnets.

Giannis et al. U.S. Pat. No. 6,422,036 discloses another clamshell type fastener for use with jewelry chains. The fastener includes multiple "anchors" 34, 36, 37 located on the inside of the fastener for receiving the loop ends of the jewelry chain. The two covers of the fastener may be closed (locked together) by a conventional hasp 30 and knob 32.

McCullough U.S. Pat. No. 6,701,583 discloses still another hinged fastener, this one comprising multiple, symmetrically arranged posts located within the fastener. By wrapping a jewelry chain around the posts inside the fastener the "hanging length" of the chain can be changed.

It is an object of the present invention to provide a fastener and connector system that is versatile enough to be used as part of a jewelry item, yet where the fastener's use is not limited to application in necklaces and bracelets.

It is a further object of the present invention to enable the interchangeability of not only one, but also multiple, bead strands or jewelry chains.

Another object of the invention is to provide a fastener and connector system that can also be used as a decorative (or functional) attachment to or component of non-jewelry items such as shoes, handbags, wallets, garments or the like.

Still another object of the invention is to provide a fastener and connector system that can be used in or on any other item that can benefit from interchangeable aesthetics (or functions) and/or aesthetics (or functional) updating, such as household goods, picture frames and albums, decorative hardware, toys and any other item that can benefit from changes and/or updates without replacement of the item in its entirety.

Another object of the invention is to provide a fastener or fasteners that can be used with interchangeable connectors.

Another object of the invention is to provide a clamshell type fastener that can be used as the decorative feature of a jewelry item or other item either singly or in tandem with other decorative fasteners.

Another object of the invention is to provide a fastener that can be used with an already manufactured jewelry item such as a brooch or pendant.

Further and additional objects will appear from the description, accompanying drawings, and appended claims.

SUMMARY OF THE INVENTION

The present invention is a system comprising one or more fasteners which, when used with one or more interchangeable connectors, can be used to create numerous articles, including but not limited to jewelry items such as earrings, rings, pendants, bracelets and necklaces, and other decorative articles. The fastener is a clamshell type device having an interior space for capturing one or more portions of one or more connectors or other items. The fastener can be made with one or more top sections that open and close separately for easier use.

In one embodiment the fastener comprises a base and a cover attached to the base by a hinge such that the covers are moveable between an open and a closed position. The base and the cover define an interior space within the fastener when the covers are in the closed position. The two covers also define at least one channel or opening when the covers are in the closed position. The cover of the fastener may be divided into a left cover and a right cover, each being separately attached to the base by a hinge so that they can be opened or closed independently of one another. Similarly, the cover may also be divided into more than two sections, each attached to the base by a hinge. One or both outer facing surfaces of the fastener may be decorated. The base and the cover define one, two or more sets of opposing notches disposed along their perimeter such that, when the base and cover are in the closed position, the notches cooperate to define a channel or opening in the fastener body.

The fastener may be used with one or more of three types of interchangeable connectors. "Barbell" type connectors comprise two functional ends connected by a (preferably cylindrical) body. More specifically, barbell type connectors comprise a first (captured) end that can be captured within the fastener, a second (free) end disposed outside the fastener that can be attached to an item of jewelry or other item, and a body interposed between the captured and free ends and which is configured so that it can extend through an opening in the fastener body. This type of connector is best suited for use with necklaces, bracelets and the like, although it is not limited to those applications.

"Open loop" type connectors form an almost complete, typically D-shaped, loop having two, typically barrel shaped, captured ends. The D-shaped loop is configured so that it can extend through a single opening in the fastener with each barrel shaped end captured within the interior of the fastener between the base and cover, thus leaving most of the loop outside the fastener. A necklace, bracelet, strap, chain or other item can be connected to the loop, either permanently or removeably.

"Opposing tab" type connectors comprise opposing tabs that fit within the openings of the closed fastener. These connectors can be a separate piece or, more commonly, part of a larger piece such as an earring, ring, pendant, buckle or the like. The opposing tabs may be connected to each other by a bar, plate or other piece depending on the application.

BRIEF DESCRIPTION OF THE DRAWINGS

FIG. 13 is a perspective view of the fastener of FIG. 1 shown as part of a wire type earring, the other part being an earring mount.

FIG. 14 is a perspective view of the earring mount of FIG. 13.

FIG. 15 is a perspective view of a post type earring mount for use with the present invention.

DETAILED DESCRIPTION OF THE INVENTION

Figures 1, 2:
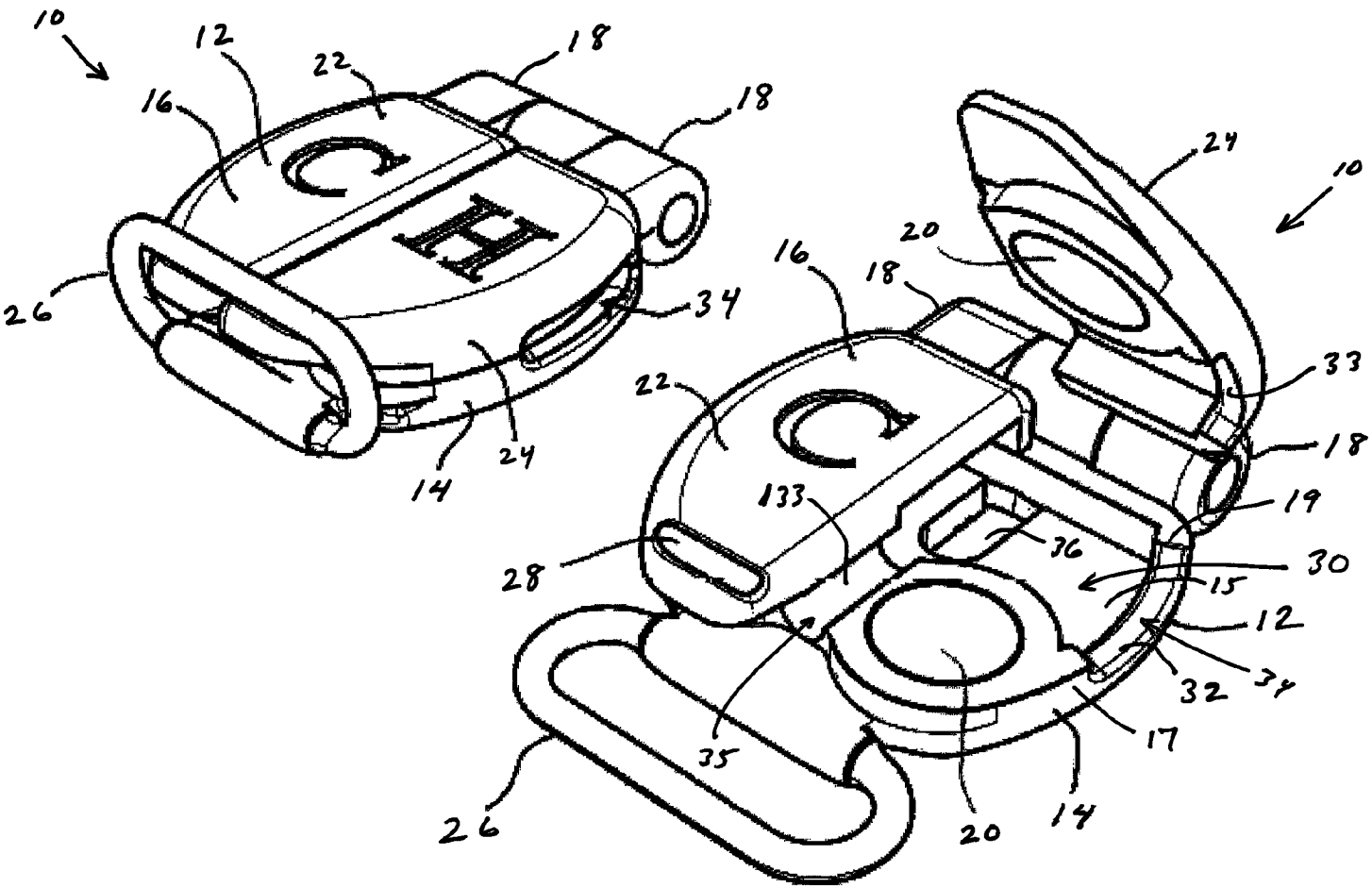
FIG. 1 is a perspective view of one embodiment of a fastener according to the present invention, shown in the closed position.
FIG. 2 is a perspective view of the fastener of FIG. 1 shown in a partially opened position.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The present invention is a system comprising one or more fasteners and one or more connectors that are versatile enough to be used as parts of any item of jewelry, or as a decorative (or functional) attachment to a shoe, purse or other item. The fastener is intended to be used with interchangeable connectors to accommodate numerous and various kinds of applications including, but not limited to, jewelry, personal fashion and household goods. Further, the fastener itself can be used as the decorative feature of a jewelry item or other item and/or may include a functional component such as a clock, tool or electronic system.

1. The Clamshell Type Fastener

Turning to the drawings, there is shown in FIGS. 1-2 a clamshell type fastener 10 according to the invention whose surface(s) may be decorated or otherwise modified. The fastener 10 comprises a body 12 having a bottom member or base 14 and a top member or cover 16 attached to each other by a hinge 18 in clamshell fashion, and optional magnets 20 or other means for securing the two members 14, 16 together in a closed position.

The base 14 is a substantially cup-shaped and comprises a bottom wall 15 and a shallow sidewall 17 extending upward from the bottom wall 15 and terminating in a rim 19. The rim defines the periphery of the base 14. As explained further below, notches 32 formed in the sidewall rim 19 help form channels or openings 34 in the fastener 10 for accommodating connectors. Two magnets 20 are disposed on either side of the base 15. A slot 133 is located between the magnets 20 and extends in a direction orthogonal to a first line defined by the opposing channels 34. The slot 133 defines a second line orthogonal to the first line. The slot 133 communicates with the exterior via an opening 35 located in the fastener 10 substantially opposite the hinge 18. A cavity 36 is centrally disposed in the bottom 15 of the base 14 at the intersection of the first and second lines defined by the channels 34 and the slot 33 respectively, and can accommodate a pin positioning disk 160 as described below.

The cover 16 may be any shape that suitably mates with the base 14, including hemispherical, cup shaped or substantially flat as shown in the illustrated embodiment. The cover 16 has a perimeter and notches 33 disposed in the perimeter substantially opposite the notches 32 in the base 14 when the fastener 10 is closed, so that the notches in the base 14 and cover 16 come together to form channels or openings 34 located in the perimeter of the fastener 10. The cover 16 may have a left side and a right side, and magnets 20 may be disposed on either side.

Optionally, the cover 16 may be divided into multiple sections, each section being connected to the base 14 by a hinge. For example, in the illustrated embodiment the cover 16 is divided into a left section or cover 22 and a right section or cover 24, making it easier to attach the fastener 10 to, say, the ends of a bracelet or other jewelry item. Each cover (or section) 22, 24 is attached to the base 14 by a hinge 18 and can be opened or closed independent of the other cover.

As explained in more detail below, the clamshell fastener 10 is versatile enough to be used with a necklace, bracelet, earring, ring or as a decorative (or functional) adornment to a notebook, shoe, purse or other article.

The fastener 10 can be changed from a closed position (shown in FIG. 1) to an open position (shown in FIG. 2) by pivotally moving one or both covers 22, 24 from a close abutting relationship with the base 14 to the open position shown in FIG. 2. In the closed position an optional closure loop 26 rotatably affixed to the base 14 opposite the hinge 18 can be rotated until it captures the cover 16 to secure the cover 16 to the base 14 and keep the fastener 10 from accidentally opening. When the fastener 10 is in the closed position part of the closure loop 26 can cooperate with optional grooves 28 disposed on the outer facing surface of the cover 16 to form a snap fit.

Along with the base 14, each respective top section or cover 22, 24 defines an interior space 32 within the fastener 10 for receiving one or more interchangeable connectors, the structure and function of which are described below. Opening one or both of the fastener covers 22, 24 exposes the interior space 32 and allows the user to install a connector or switch connectors.

As previously noted, the base 14 and the cover 16 define one, two or more sets of opposing notches 32, 33 disposed along their perimeter such that, when the base 14 and cover 16 are in the closed position, the notches 32, 33 cooperate to define a channel or opening 34 in the fastener body 12. As used herein, the term "notches" may refer to small indentations in the perimeter of the base 14 and cover 16, or longer indentations extending around part of the perimeter of the base 14 and cover 16. Preferably, there are two substantially opposed channels or openings 34 in the fastener body 12 located on either side of the fastener 10. Optionally, each opening 34 can be made large enough to accommodate multiple connectors or, as described below, opposing ends of a single open loop type connector or a tab type connector as will be described.

The outer facing surface(s) of the fastener 10 can be engraved (with initials as shown in FIG. 1 or other ornamental features), polished, embossed, given a matte finish, or otherwise decorated, thereby enabling the fastener 10 to be used as the key decorative element of a jewelry or other item. Alternatively, a separate decorative element, such as a stone, medallion, small sculpture, cameo, clock, tool, or electronic item, etc. (not shown), can be affixed, permanently or otherwise, to the outer facing surface of the base 14 or cover 16.

2. The Connectors

In a key aspect of the invention, the fastener 10 can be used with various types of interchangeable connectors to form an item of jewelry or other item. The connectors are removable and interchangeable, enabling the fastener 10 to be used in numerous applications. In general, the fastener 10 may be used with three general types of connectors: a "barbell" type connector, an "open loop" type connector and an "opposing tab" type connector. Each will now be described in turn.

A. "Barbell" Type Connector

The first kind of connectors that can be used with the fasteners of the present invention are "barbell" type connectors, so-called because they comprise two functional ends connected by a (preferably cylindrical) body. More specifically, these barbell type connectors comprise a first (captured) end that can be captured within the fastener, a second (free) end disposed outside the fastener that can be attached to an item of jewelry or other item, and a body interposed between the captured and free ends and which is configured so that it can extend through an opening 34 in the fastener 10. This type of connector is best suited for use with necklaces, bracelets and the like, although it is not limited to those applications.

Figure 3:
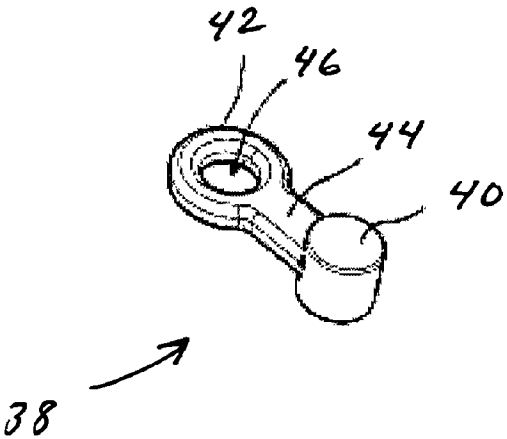
FIG. 3 is a perspective view of a barbell type connector that can be used with the fastener of FIGS. 1 and 2.

FIG. 3 shows one barbell type connector 38 for use with the fastener 10 of the present invention. The connector 38 comprises a captured end 40 and a free end 42 connected by an elongated body 44. The captured end 40 may be any shape that enables it to be captured within the fastener 10 so that it cannot be removed without opening the fastener 10, including cylindrical, spherical or barrel-shaped (as in FIG. 3), and is affixed to the elongated body 44 with its axis substantially perpendicular to the axis of the elongated body 44.

The captured end 40 is larger than the openings 34 in the fastener 10 so that, when positioned within the interior of a fastener 10 which is then subsequently closed, the captured end 40 cannot be removed without opening the fastener 10. The captured end 40 preferably is a solid geometric shape, such as the cylinder shown in FIG. 3, but it can also be a sphere, cube or any other functional shape that enables the captured end 40 to fit securely within the interior 30 of a closed fastener 10 but is larger than the opening 34.

Figure 4:
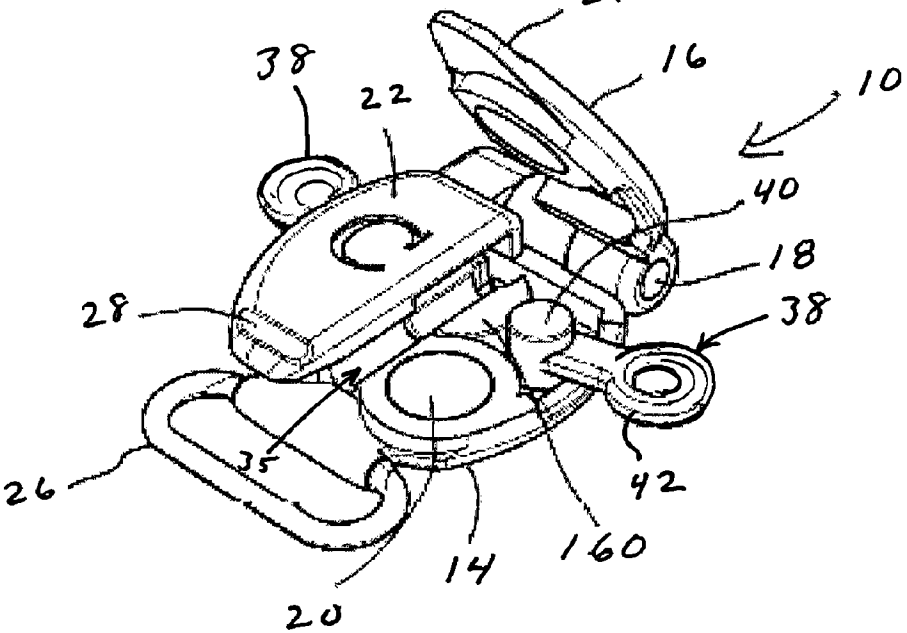
FIG. 4 is a perspective view of the fastener of FIG. 2 shown with two barbell type connectors.

FIG. 4 shows a fastener 10 with two barbell type connectors 38, one disposed within the interior of each half of the fastener 10. An optional positioning element 160 may be placed within the fastener interior to help position the connector 38, although its primary function is to hold a pin or clasp as described in detail below. The connector free end 42 may be any desired shape depending on aesthetics and function, including crimped. As shown in FIG. 3, the free end 42 is substantially toroidal (doughnut) shaped and defines a centrally disposed opening 46 for receiving and retaining a loop, strand, wire or other article.

Multiple pairs of barbell type connectors 34 can be used with a single fastener 10 to allow for a multi-strand necklace or bracelet. The connectors 34 on each side of the fastener 10 may or may not be connected to each other by, for example, welding or soldering.

Figures 5, 6:
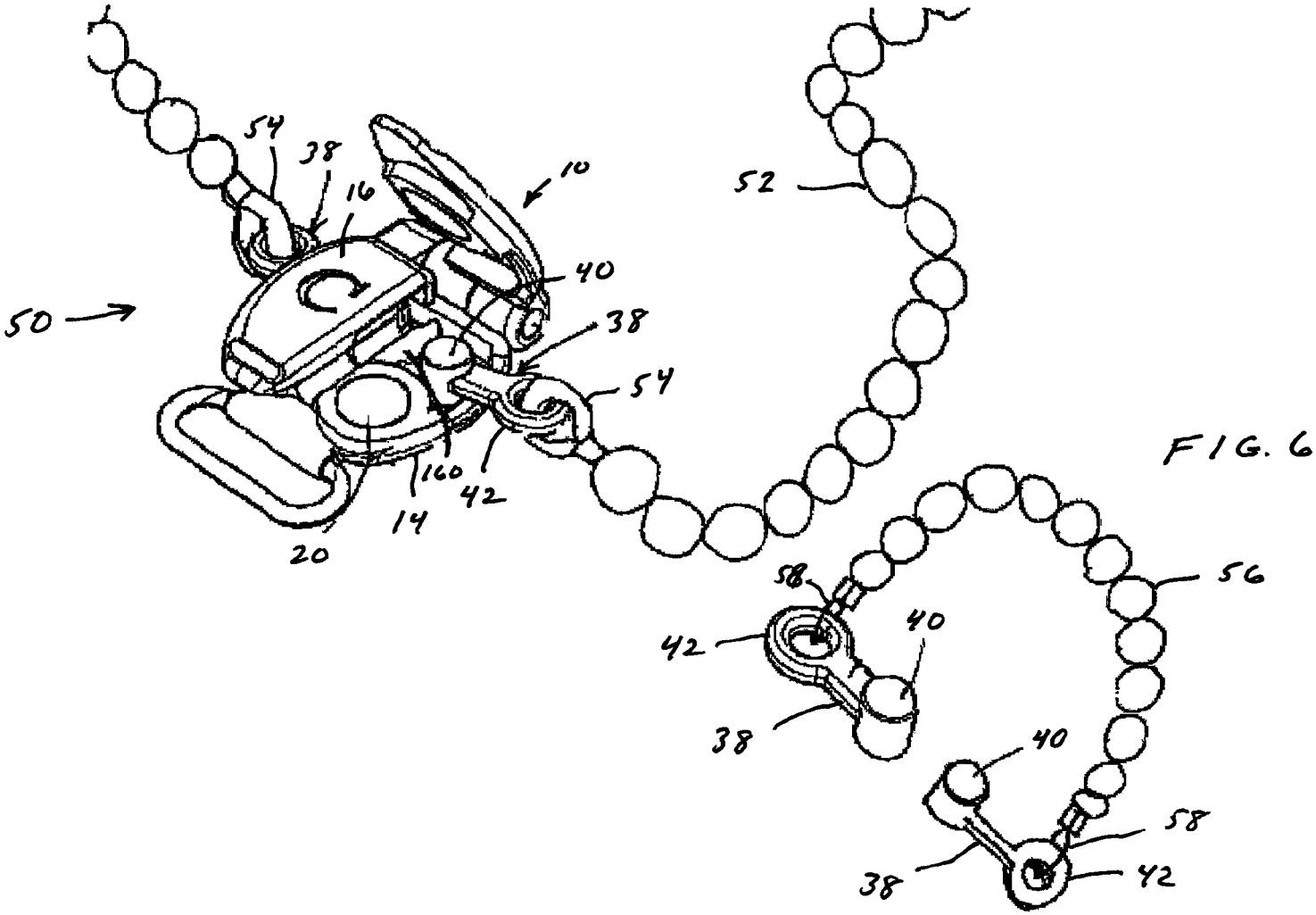
FIG. 5 is a perspective view of the fastener of FIG. 2 shown as part of a necklace.
FIG. 6 is a perspective view of a single strand bracelet and connectors for use with the fastener of the present invention.

A fastener 10 and two barbell type connectors 38 can be used together to form part of a necklace or bracelet in which the fastener is used either strictly as a fastener or as a decorative element. For example, FIG. 5 is a perspective view of the fastener 10 of FIG. 2 shown as part of a necklace 50. Barbell connectors 38 are used to secure a necklace strand 52 to the fastener 10. The necklace strand 52 includes toroidal bodies (o-rings) 54 at each end of the strand 52 which may be permanently or removeably affixed to the barbell connectors 38. The necklace 50 may be worn with the fastener 10 in front as a front decorative piece, or with the fastener 10 in back.

FIG. 6 is a perspective view of a single strand bracelet 56 and barbell connectors 38 for use with the fastener of the present invention. Like the necklace strand 52, the bracelet strand 56 includes o-ring wire connectors 58 at end of the strand 56 which receive the free ends 42 of the barbell connectors 38.

Figure 7:
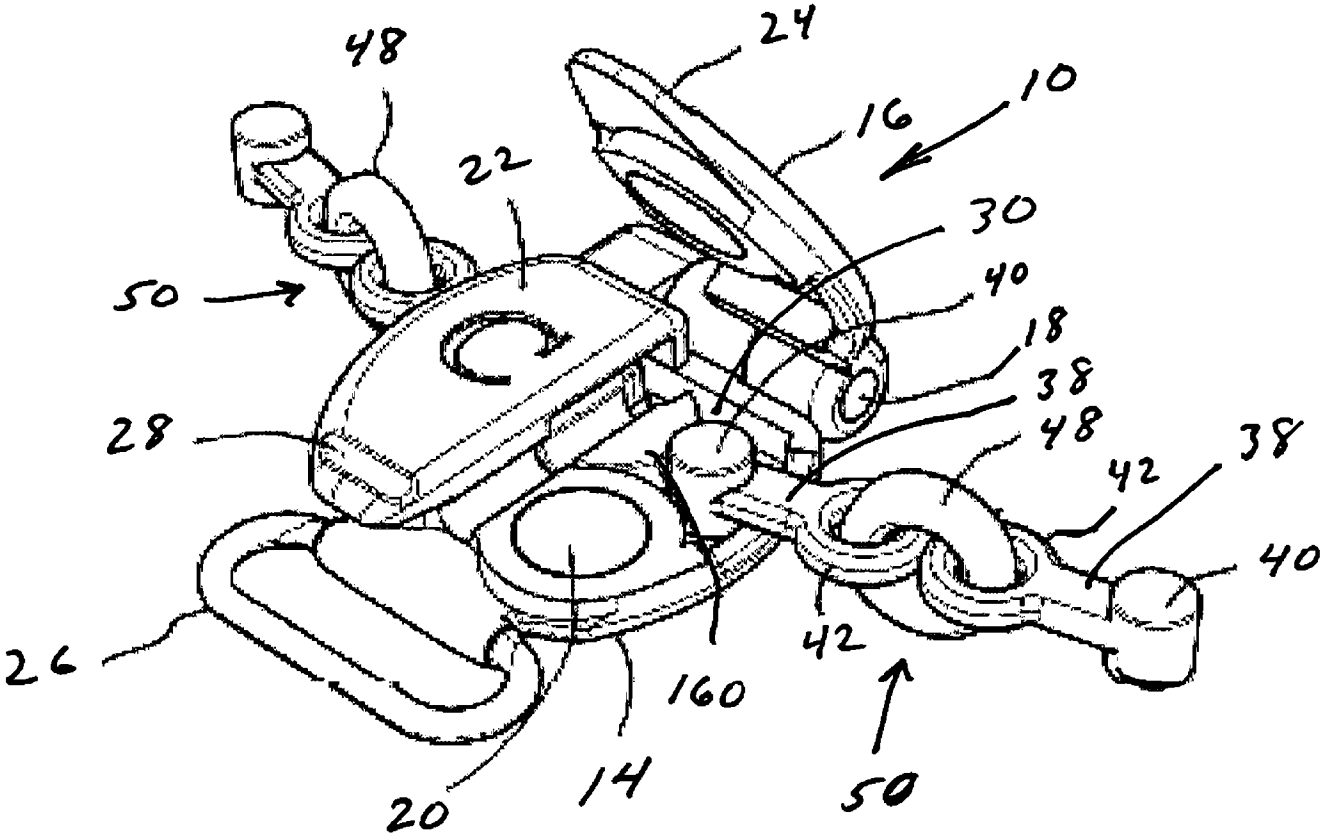
FIG. 7 is a perspective view of the fastener of FIG. 2 shown with two double link type connectors.

Two barbell type connectors 38 can be joined together with one or more O-rings 48 or other links, such as a chain, bead or other type of connection, to form a double link connector. For example, FIG. 7 shows a partial decorative system comprising the fastener 10 of FIGS. 1 and 2 and two double link connectors 50. One captured end 40 of each double link connector 50 is disposed inside the interior space 30 of the fastener 10 between the fastener base 14 and top cover 16 so that, when the fastener 10 is closed, each double link connector 50 is securely anchored to the fastener 10 and has a second captured end 40 outside the fastener 10.

Figure 8:
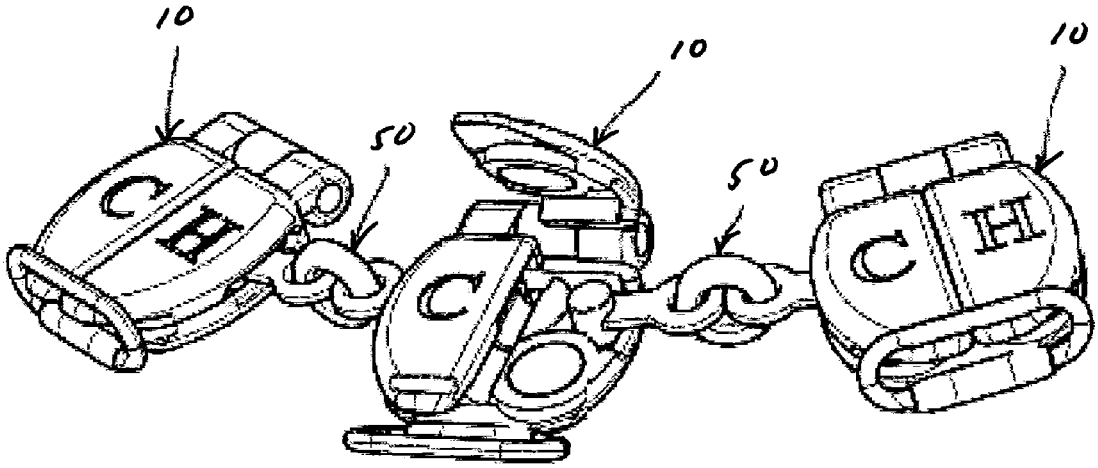
FIG. 8 is a perspective view of three fasteners like that in FIG. 1 linked together.

As shown in FIG. 8 two or more fasteners 10 can be connected to each other by using double link connectors 50. By connecting multiple fasteners 10 together to form a complete loop a complete jewelry item such as a bracelet or necklace can be created. Alternatively, multiple fasteners can be connected in patterns other than a loop to create other decorative and functional objects.

B. "Open Loop" Type Connector

Figures 9, 10:
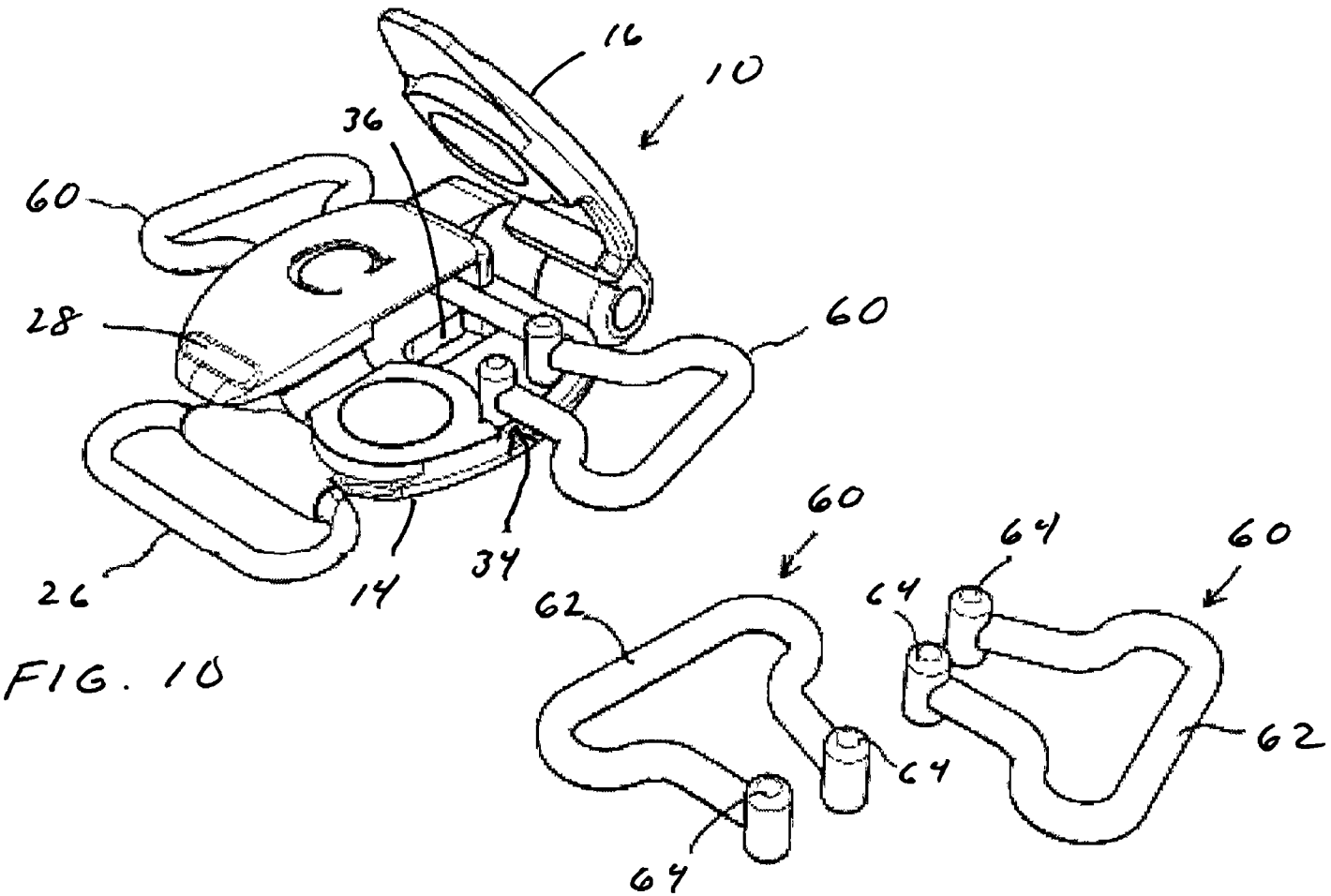
FIG. 9 is a perspective view of two open loop type connectors that can be used with the fastener of FIGS. 1 and 2.
FIG. 10 is a perspective view of the fastener of FIG. 2 shown with two open loop connectors.

A second type of connector that can be used with the fastener 10 of the present invention is an "open loop" type connector, so named because it forms an almost complete loop having two captured ends. Two such open loop connectors 60 are shown in FIG. 9. Each open loop connector 60 comprises an open, typically C- or D-shaped loop 62 terminating at either end in a typically barrel shaped (captured) end 64. Referring to FIG. 10, the D-shaped loop is configured so that it can extend through a single opening 34 in the fastener 10 with each barrel shaped end 64 captured within the interior of the fastener 10 between the base 14 and top cover 16, thus leaving most of the loop 62 outside the fastener 10. A necklace, bracelet, ankle bracelet, watch strap, chain or other item can be connected to the loops 62, either permanently or removeably.

Figure 11:
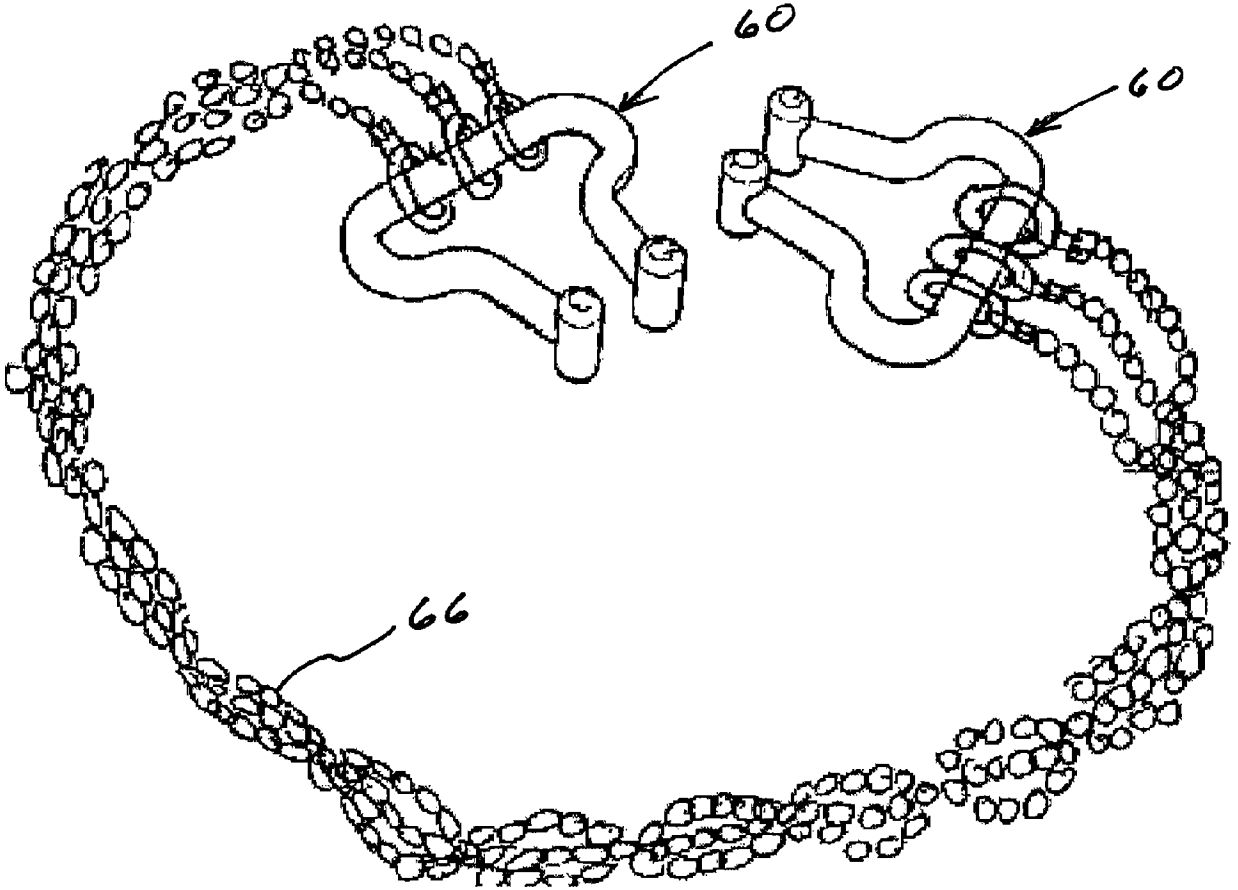
FIG. 11 is a perspective view of a multi-stand bracelet and two open loop connectors for use with the fastener of the present invention.

For example, FIG. 11 is a perspective view of a multi-stand bracelet 66 connected at either end to an open loop connector 60 for use with the fastener 10 of the present invention.

Figure 12:
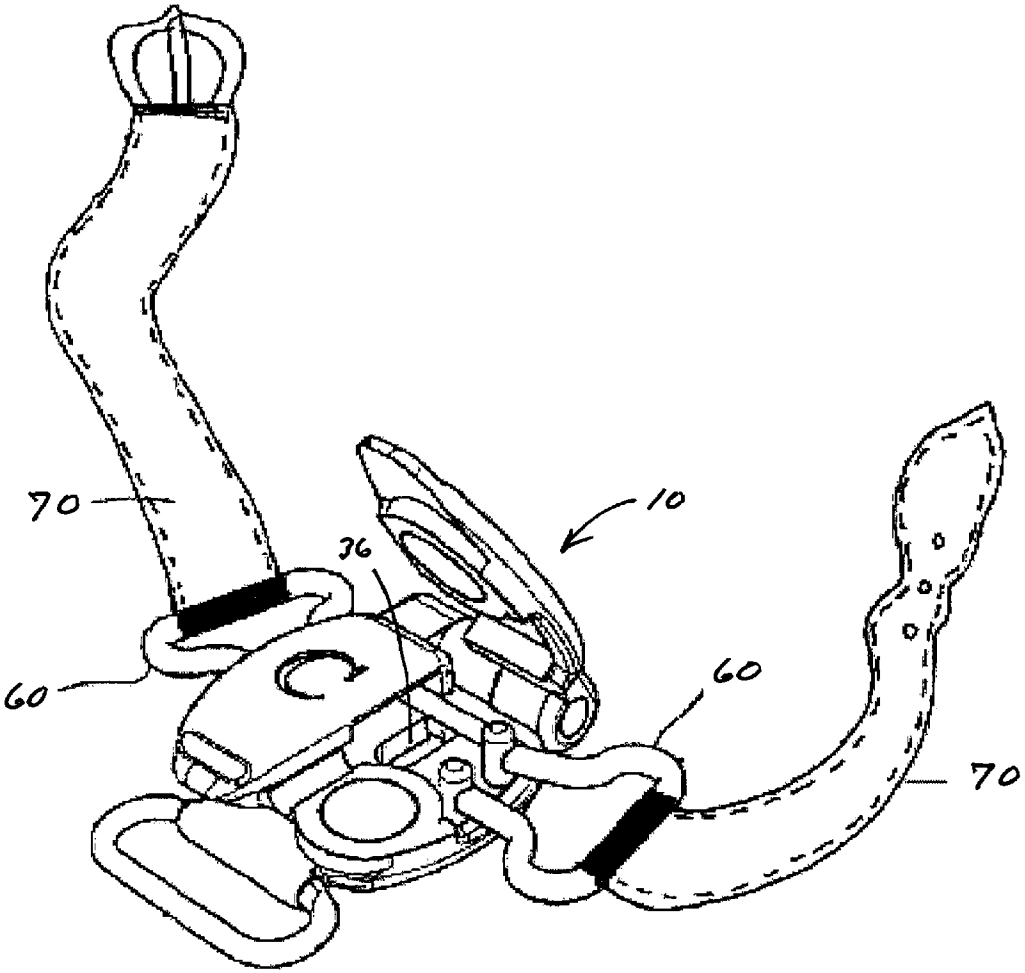
FIG. 12 is a perspective view of the fastener of FIG. 2 shown with a two piece strap attached to the fastener by two open loop connectors.

FIG. 12 is a perspective view of the fastener 10 of FIGS. 1-2 shown with a two piece strap 70 attached to the fastener by two open loop connectors 60. A single piece strap (not shown) may also be used, where one or both ends of the single piece strap are connected to an open loop connector 60.

C. "Opposing Tab" Type Connector

The third type of connector that can be used with the fastener 10 of the present invention is an "opposing tab" type connector, so called because it comprises opposing tabs that can fit within the openings 34, 35 of the closed fastener 10. The opposing tab connector can be a separate piece or, more commonly, part of a larger piece such as an earring, ring, cufflink, shoe clip, or hair ornament. The opposing tabs may be connected to each other by a bar, plate or other structural piece depending on the application, as will now be described. This type of connector is best suited for use with earrings, rings, cufflinks, buckles and the like, as well as non-jewelry items for mounting to handbags, folios, household goods and other items, although it is not limited to those applications.

FIG. 13 shows fastener 10 and opposing tab type connector 76 adapted for use as part of a wire earring 78 for a pierced ear. The fastener 10 serves as the primary decorative part of the earring while the opposing tab connector 76 serves as a mount for the earring wire 80, which may be of the shepherd hook variety shown or another configuration, e.g., a French wire. The fastener 10 is similar to the one shown in FIGS. 1 and 2 and described above. The opposing tab connector 76 and earring wire 80 are best shown in FIG. 14. The opposing tab connector 76 is substantially C-shaped, and comprises substantially L-shaped opposing tabs 82 extending toward each other in the same plane and affixed to a bracket or bar 84 which connects the L-shaped tabs 82. The ear wire 80 extends from the back of the bracket 84 and is oriented substantially orthogonally to the axis of the bracket 84. To make the earring of FIG. 13 the fastener 10 must be opened so that the opposing tab connector 76 can be positioned with the ends of the L-shaped tabs 82 extending within the two channels 34 located on either side of the fastener 10. The fastener 10 is then closed so that the tabs 82 remain captured with the channels 34. Preferably the tabs 82 are located a distance away from the bracket 84 so that, when the connector 76 is secured to the fastener 10, the connector 76 cannot move at all.

FIG. 15 is a perspective view of a post type earring mount 88 for use with the present invention. The post type earring mount 88 comprises a body 90 that can be any suitable shape, including round and flat as shown in the figure, and opposing L-shaped tabs 92 that fit within the openings 34 in a fastener body (not shown). The earring can be secured to a user's ear by any suitable means, including by a, post and backing that fits on the post, or magnet. In the illustrated embodiment, the earring 88 comprises a post 94 extending from the back of the flat body 90 opposite the fastener 10, and a hinged loop 96 affixed to the plate 90 that cooperates with the post 94 to secure the earring mount 88 to the wearer.

Figure 17:
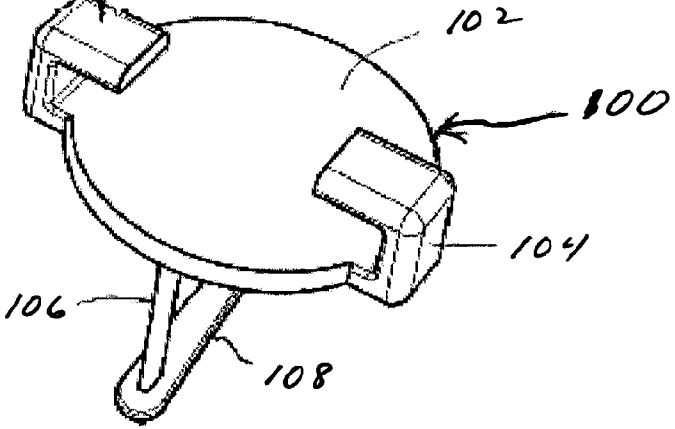
FIG. 17 is a perspective view of the post type earring mount of FIG. 16.
Figure 16:
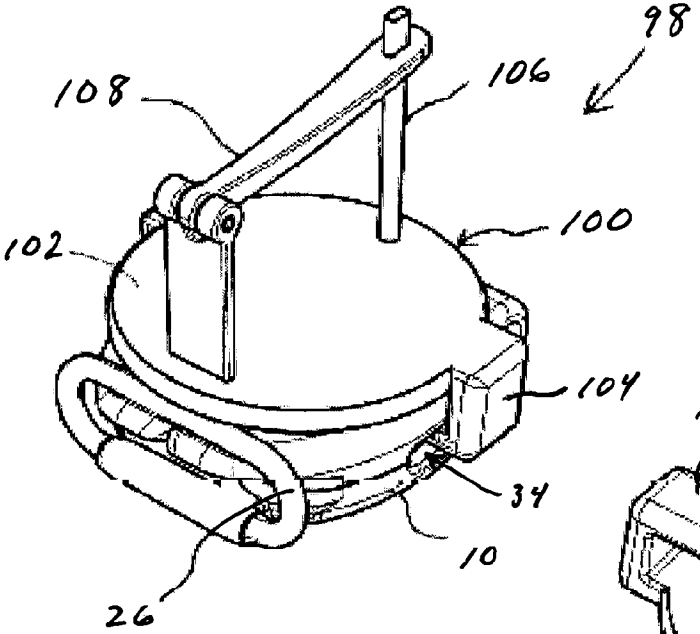
FIG. 16 is a perspective view of the fastener of FIG. 1 shown as part of a post type earring, the other part being a post type earring mount.

FIG. 16 is a perspective view of the fastener 10 of FIG. 1 shown as part of another post type earring 98, the other part being a post type earring mount 100. FIG. 17 is a perspective view of the post type earring mount 100 shown in FIG. 16. The earring mount 100 comprises a body 102, which can be any suitable shape including round and flat as shown in the figure, and opposing typically C- or L-shaped tabs 104 that fit within two openings 34 in the fastener body, a notched post 106 extending from the back of the flat body 102 opposite the fastener 10, and a hinged arm 108 affixed to the plate 102 that cooperates with the post 106 to secure the earring 98 to the wearer.

Figure 18:
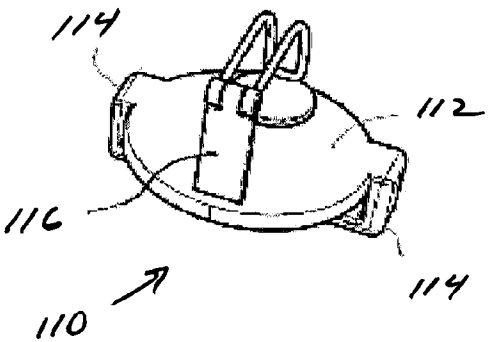
FIG. 18 is a perspective view of a clip type earring mount that can be used with the fastener of FIG. 1.

FIG. 18 is a perspective view of a clip type earring mount 110 that can be used with the fastener 10 of FIGS. 1-2 for non-pierced ears. The clip type earring mount 110 comprises a body 112 with opposing C- or L-shaped tabs 114 that fit within two openings 34 in the fastener body, and a clip 116 hingedly affixed to the body 112 that is biased against the body 112 to secure the earring to the wearer.

The features of FIGS. 17 and 18 may be combined by hinging the post of FIG. 17 so that it may fold down to create an earring suitable for either a pierced or non-pierced ear.

Figure 19:
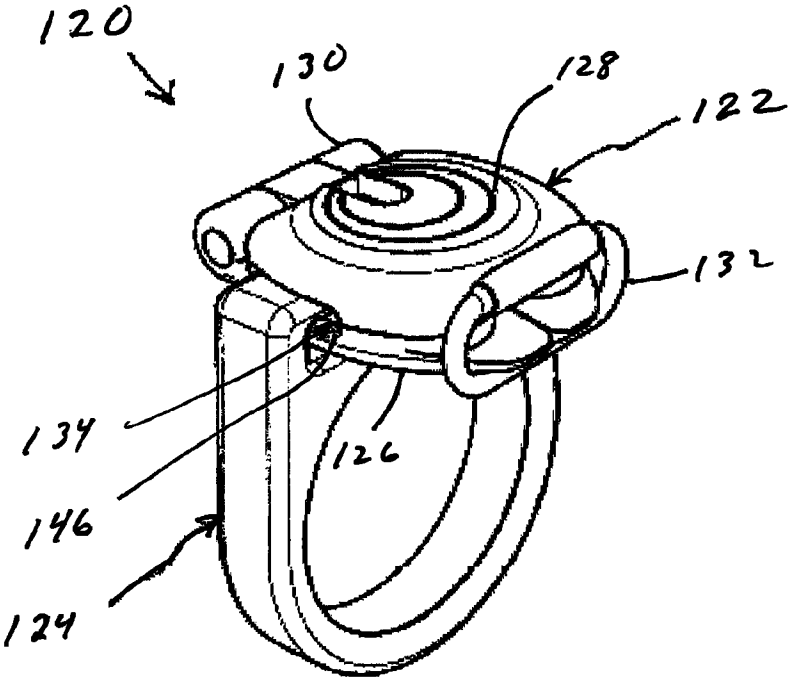
FIG. 19 is a perspective view of a fastener according to the present invention shown as part of a ring, the other part being a ring mount.

FIG. 19 is a perspective view of a ring 120 made from a clamshell type fastener 122 according to the present invention and a ring mount 124 also according to the present invention. Like the fastener 10 of FIGS. 1-2, the fastener 122 shown in FIG. 19 comprises a body having a base 126 and a cover 128 attached to each other by a hinge 130 in clamshell fashion, and means for securing the cover 128 to the base 126 in the closed position. In the closed position a closure loop 132 rotatably affixed to the base 126 opposite the hinge 130 can be rotated until it captures the cover 128 to secure the cover 128 to the base 126 and keep the fastener 122 from accidentally opening. The base 126 and cover 128 define an interior space (not shown) within the fastener 122 for receiving part of the ring mount 124. Opening the fastener cover 128 exposes the interior space and allows the user to install the ring mount 124. The base 126 and the cover 128 define a set of opposing notches disposed along their perimeter such that, when the base 126 and cover 128 are in the closed position shown in FIG. 19, the notches cooperate to define two opposing channels or openings 134 in the fastener body.

Figure 20:
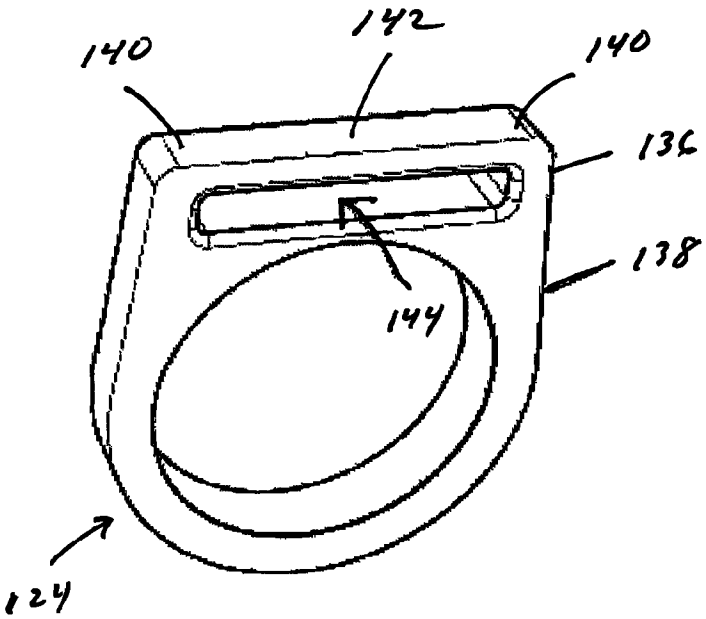
FIG. 20 is a perspective view of the ring mount of FIG. 19.

As best shown in FIG. 20, the ring mount 124 comprises a bracket 136 and a finger band or loop 138. The bracket 136 comprises opposing L-shaped tabs 140 that are connected together at their opposing ends to form a solid bar 142. The bracket 136 is mounted to the band 138 so that together they define a slot 144 which can accommodate the base 126 of the fastener 122.

To construct the ring 120, the fastener 122 is opened so that the base 126 can be slid within the slot 144 in the ring mount 124. When the base 126 is completely slid within the slot 144 the bar 142 should extend across the notches 146 in the base 126 that help define the channels 134. The cover 128 is then brought against the base 126 to close the fastener 122, securing the ring mount 124 to the fastener 122 as shown in FIG. 19. In this embodiment the fastener 122 includes an engraved cover 128, although any suitable decoration may be incorporated into or affixed to the fastener 122.

Optionally, instead of a single solid bar 142, the ring mount may have two opposing disconnected tabs as in previous embodiments.

Figures 21, 22:
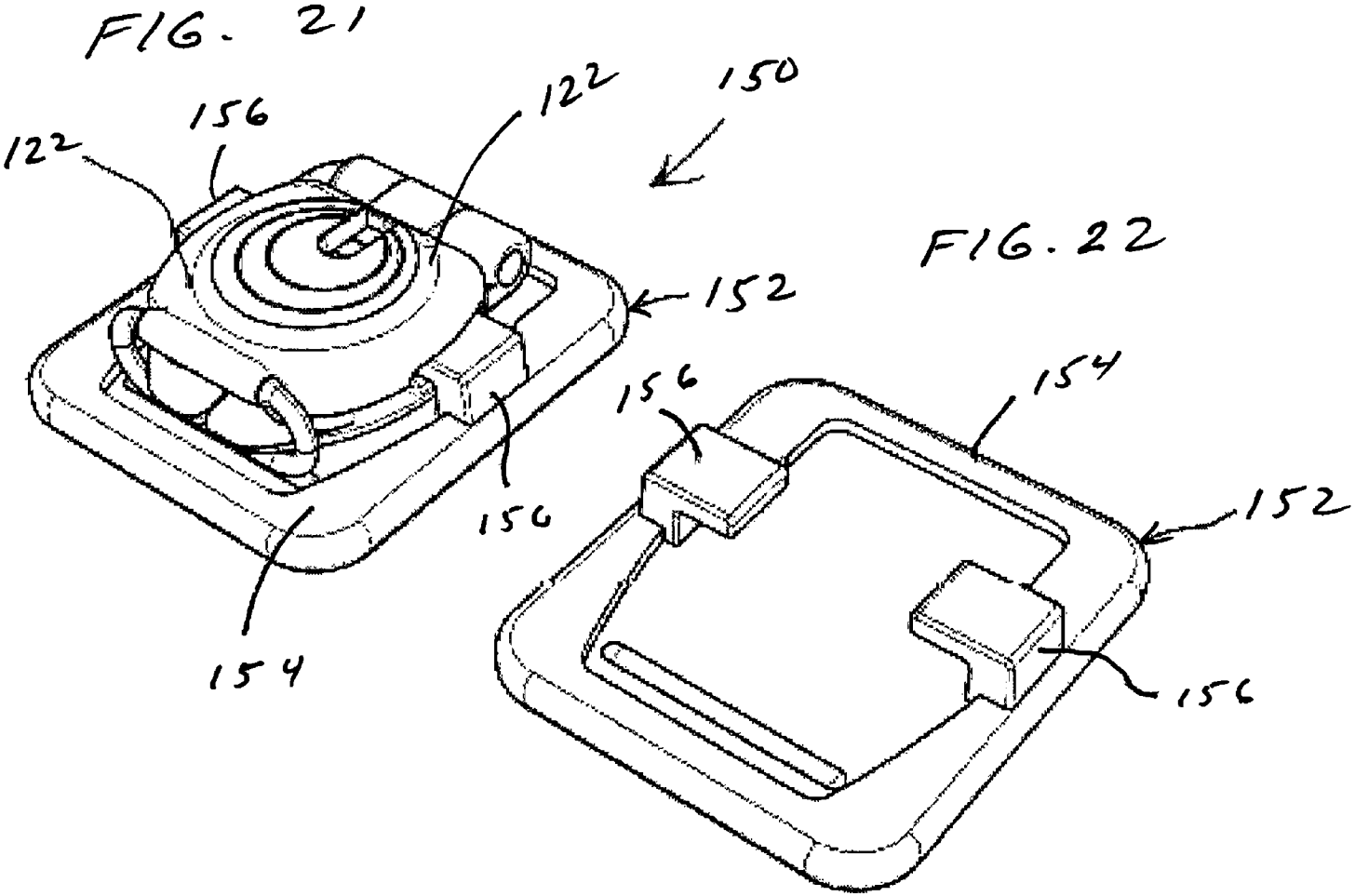
FIG. 21 is a perspective view of a fastener according to the present invention shown as part of a decorative clasp, the other part being a mounting plate.
FIG. 22 is a perspective view of the mounting plate of FIG. 21.

FIG. 21 is a perspective view of a fastener 122 according to the present invention shown as part of a decorative element to be permanently or removeably affixed to another item, the other part being a mounting plate 152. The fastener 122 is the same as that shown in FIGS. 19-20.

FIG. 22 is a perspective view of the mounting plate 152. The mounting plate 152 comprises a body 154 and two opposing C- or L-shaped tabs 156 extending from the body 154. The clasp 150 can be attached to a shoe, purse, notebook or other article. The body 154 can be any suitable shape that can accommodate opposing tabs and mate, as desired, with the object to which it is to be affixed.

3. Pin Positioning Disk

To affix a fastener 10 to a jewelry item or other item having a narrow elongated clip or pin, the clip or pin may be inserted through the openings 34 in the closed fastener 10. It has been found that when a fastener 10 is affixed to an item in this way the fastener 10 can wiggle or otherwise move with respect to the item if the clip or pin is narrower than the channels 34, which is undesirable. To avoid this problem, a pin positioning disk 160 can be placed inside the fastener 10 to hold the clip or pin in place.

Figure 23:
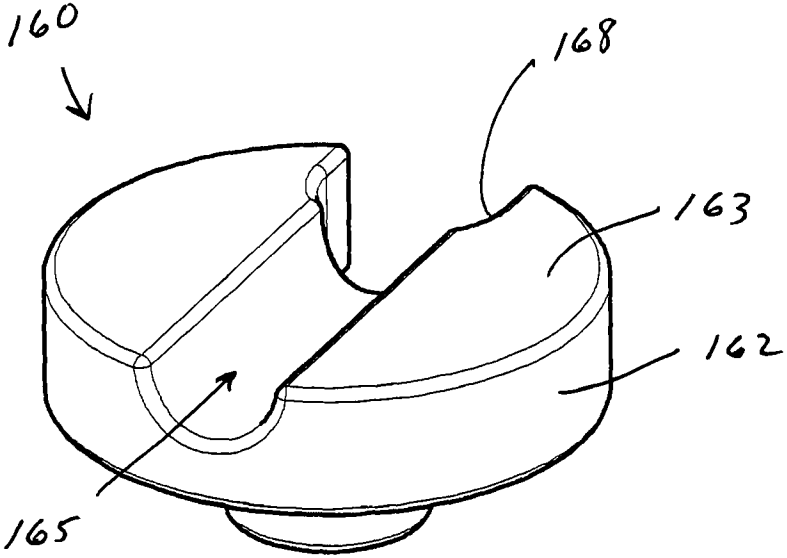
FIG. 23 is a top perspective view of a pin positioning disk that may be used with the fastener of the present invention.
Figure 24:
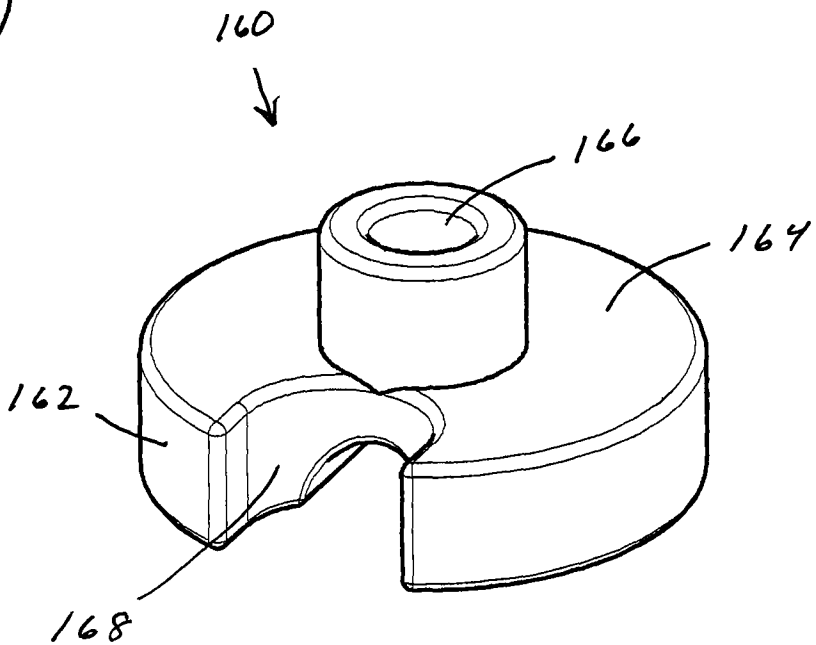
FIG. 24 is a bottom perspective view of the pin positioning disk of FIG. 23.

FIGS. 23 and 24 are top and bottom perspective views of a pin positioning disk 160. The disk 160 comprises a disk shaped body 162 having a top surface 163 and a bottom surface 164, a slot 165 diametrically disposed in the top surface 163, and a round cylindrical plug 166 extending outward from the bottom surface 164. A curved notch 168 is located on the perimeter of the disk body 162, preferably at one end of the slot 165.

Figure 25:
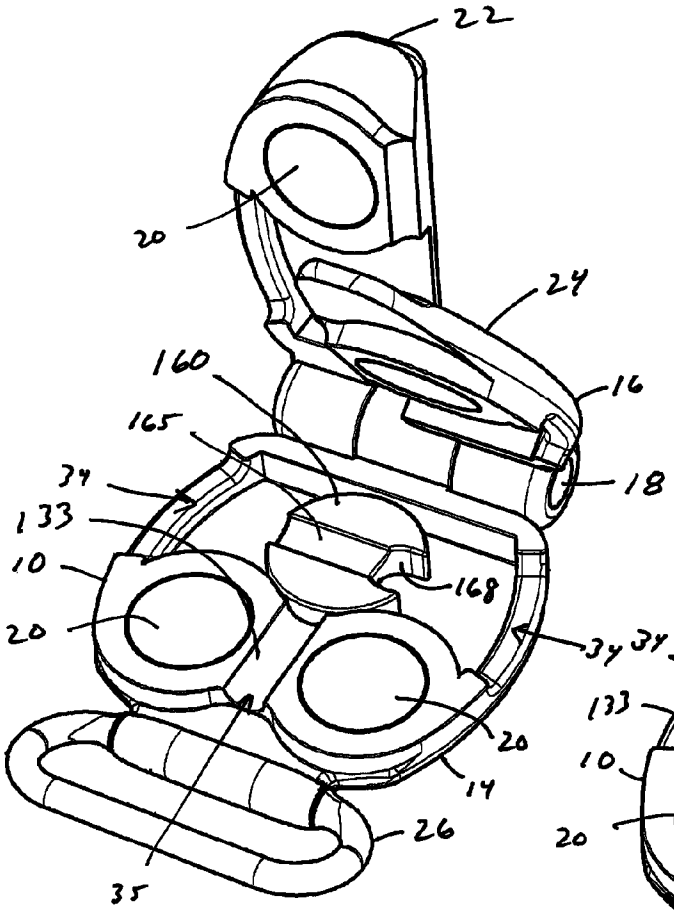
FIG. 25 is a perspective view of an open fastener shown with the pin positioning disk of FIG. 23 installed in a first position.

FIG. 25 is a perspective view of an open fastener 10 shown with a pin positioning disk 160 installed so that the slot 165 is aligned with a line defined by the opposing side channels 34. The disk plug 166 (FIG. 4) may be inserted into the cavity 36 (FIG. 2) to hold the disk 160 in place within the fastener 10. The pin positioning disk 160 can be rotated so that the slot 165 is aligned with either the horizontal line defined by the opposing side channels 34 or the vertical line defined by the slot 133 between the magnets 20 or at any angle consistent with the geometry of the opposing side channels 34.

When an item having a clip or pin is to be connected to the fastener 10, the clip or pin (not shown) can be inserted through one or both channels 34 and into the slot 165. By restricting the movement of the pin, the disk 160 helps hold the two pieces in a fixed relationship. Alternatively, should a user wish to attach a connector having an end that fits within the notch 168, the connector end can be positioned within the notch 168 to restrict any movement of the connector.

Figure 26:
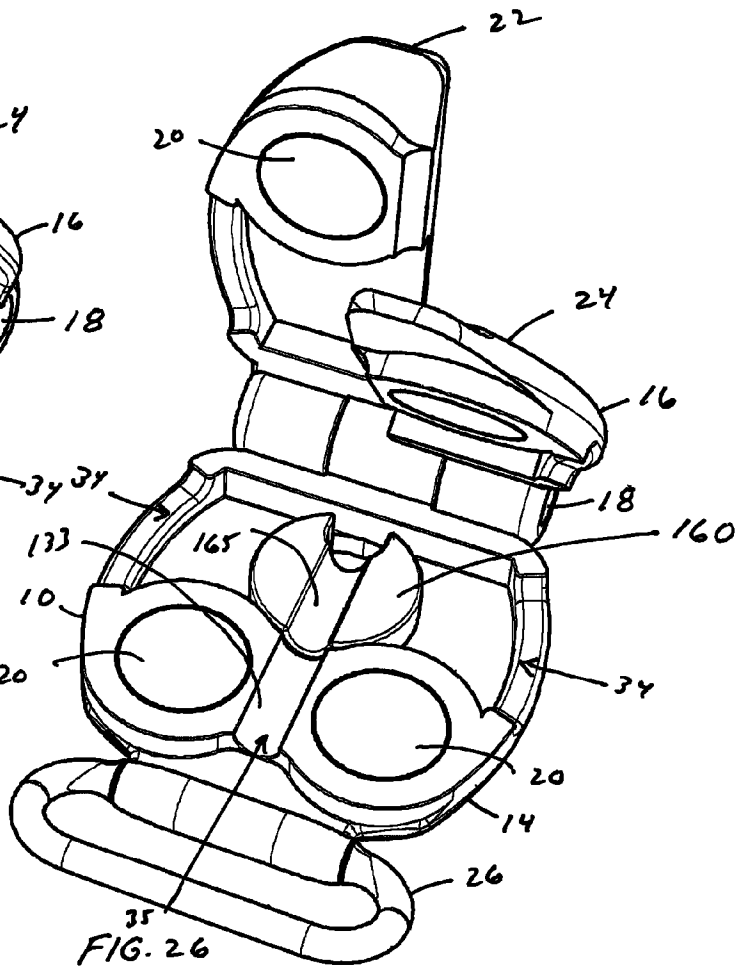
FIG. 26 is a perspective view of an open fastener shown with the pin positioning disk of FIG. 23 installed in a second position.

FIG. 26 is a perspective view of an open fastener 10 shown with a pin positioning disk 160 installed so that the slot is aligned with the opening 35 located opposite the hinge 18. When an item having a clip or pin is affixed to the fastener 10, the clip or pin (not shown) can be inserted through the opening 35 and into the slot 165. The slot 165 helps secure the two pieces in a fixed relationship.

4. Other Applications

The system of the present invention is intended to be versatile enough to be used in numerous applications, with one or more fasteners and one or more connectors, and as a decorative element or simply as a fastener. In addition to the applications described above, and without limitation, here are a more examples of how the invention may be used. In these applications the fastener sometimes is used strictly as a fastener, sometimes strictly as a decorative element, and sometimes as both.

Brooch, Pin or Dress Clip

When the connector is equipped with means for pinning or clipping the fastener to a blouse or other clothing article it can serve as a brooch, pin or dress clip. Alternatively, a pin or clip can be affixed to the fastener directly, allowing it to be used as a brooch, pin or dress clip absent a connector, while still retaining flexibility to be used with other items.

Pendant

The fastener can also be used with a connector to drop from a necklace, bracelet, brooch, decorative clasp, hanger (e.g., Christmas ornament, sun catcher), or other object (e.g., the zipper tab on a purse or garment) for use as a pendant.

Cufflink, Hair Ornament, Shoe Ornament

The connector may also be equipped with means for affixing a fastener to any number of other items, including but not limited to a shirt cuff, suit lapel, hair, shoes, etc.

Thus there has been described a system which, when used with interchangeable fasteners, connectors or other items, can be used in numerous applications, including but not limited to jewelry (e.g., earrings, rings, pendants, bracelets, and necklaces), fashion articles (handbags, folios, wallets, garments, etc.), and other decorative applications (e.g., household goods, toys, hardware, etc.). The fastener is a clamshell type device having an interior space for capturing the end(s) of one or more connectors or other items. The fastener can be made with a top member or cover comprising two or more sections that open and close separately for easier use.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A fastener and connector system comprising:

a fastener comprising a base having a substantially flat bottom wall and a shallow sidewall extending upward from the bottom wall and terminating in a rim, one or more covers attached to the base by one or more hinges such that the one or more covers are moveable between an open and a closed position, the bottom wall and the one or more covers lacking any openings therethrough, the base and the one or more covers each having one or more notches disposed along its perimeter such that, when the one or more covers are in the closed position, the one or more notches cooperate to define one or more channels, each channel configured to accommodate one or more connectors, the base and the one or more covers also defining an interior space within the fastener when the one or more covers are in the closed position, and means for securing the one or more covers in the closed position, the base and the one or more covers having exterior surfaces adapted for decorability; and at least one connector, separate and removable from the fastener, the connector having a first end that is small enough to fit within the interior space of the fastener when the one or more covers are closed but too big to be removed without moving the one or more covers to the open position, a second end located outside the fastener when the fastener is in the closed position and which can be affixed to an item, and a body connecting the first and second ends configured to extend through one of the channels when the one or more covers are in the closed position;

wherein the cover comprises a left cover and a right cover, each being separately attached to the base by a separate hinge so that they can be opened or closed independently of one another.

2. The fastener and connector system of claim 1 wherein the fastener further comprises a closure loop rotatably affixed to the base opposite the hinge, and wherein the closure loop can be rotated until it captures the cover to secure the cover to the base.

* * * * *